US007747147B2

(12) United States Patent
Konishi et al.

(10) Patent No.: US 7,747,147 B2
(45) Date of Patent: Jun. 29, 2010

(54) HEATING UNIT AND HEATING APPARATUS

(75) Inventors: Masanori Konishi, Kagawa (JP); Tsugunori Okahara, Kagawa (JP); Akira Nishio, Kagawa (JP); Dai Kusano, Fukushima (JP); Miwa Takahashi, Kagawa (JP)

(73) Assignee: Panasonic Corporation, Osaka (JP)

( * ) Notice: Subject to any disclaimer, the term of this patent is extended or adjusted under 35 U.S.C. 154(b) by 793 days.

(21) Appl. No.: 11/591,418

(22) Filed: Oct. 26, 2006

(65) Prior Publication Data

US 2007/0098377 A1 May 3, 2007

(30) Foreign Application Priority Data

Nov. 2, 2005 (JP) ..... 2005-319296

(51) Int. Cl.
*A45D 20/40* (2006.01)

(52) U.S. Cl. ..... 392/407; 392/427

(58) Field of Classification Search ..... 392/407
See application file for complete search history.

(56) References Cited

U.S. PATENT DOCUMENTS

| | | | | |
|---|---|---|---|---|
| 5,195,165 | A * | 3/1993 | Ono et al. | 392/407 |
| 5,907,663 | A * | 5/1999 | Lee | 392/407 |
| 5,951,896 | A | 9/1999 | Mahawili | |
| 6,654,549 | B1 | 11/2003 | Konishi | |
| 6,845,217 | B2 | 1/2005 | Konishi | |
| 6,909,841 | B2 * | 6/2005 | Linow et al. | 392/407 |
| 7,184,656 | B2 | 2/2007 | Konishi | |
| 7,215,879 | B2 * | 5/2007 | Morikawa et al. | 392/407 |
| 2002/0096984 | A1 | 7/2002 | Konishi et al. | |
| 2005/0069308 | A1 * | 3/2005 | Morikawa et al. | 392/407 |
| 2007/0110413 | A1 | 5/2007 | Konishi | |

FOREIGN PATENT DOCUMENTS

| | | |
|---|---|---|
| CN | 1496193 | 5/2004 |
| CN | 1622695 | 6/2005 |
| JP | 62-76495 | 5/1987 |
| JP | 2-52296 | 4/1990 |
| JP | 10-241844 | 9/1998 |
| JP | 2001-155692 A | 6/2001 |
| JP | 2002-043037 | 2/2002 |
| JP | 2002-106853 | 4/2002 |
| JP | 2002-184561 | 6/2002 |
| JP | 2002-329570 | 11/2002 |
| JP | 2003-142237 | 5/2003 |
| JP | 2004-245499 A | 9/2004 |

(Continued)

*Primary Examiner*—Thor S Campbell
(74) *Attorney, Agent, or Firm*—Harness, Dickey & Pierce, P.L.C.

(57) ABSTRACT

For the purpose of providing a heating unit being small in size, high in efficiency, long in service life, and high in versatility so as to be easily adaptable to various applications, and providing a heating apparatus that uses the heating unit, the heating unit is configured so that a first glass tube is protected against contaminants and the like using a second glass tube, caps and spacers, a reflective sheet may be disposed in a clearance between the first glass tube and the second glass tube, and the clearance in which the reflective sheet is disposed is sealed using the caps. The heating apparatus uses the heating unit described above as a heat source.

21 Claims, 13 Drawing Sheets

FOREIGN PATENT DOCUMENTS

| | | |
|---|---|---|
| JP | 2004-259701 | 9/2004 |
| JP | 2005-108686 | 4/2005 |
| JP | 2005-149809 | 6/2005 |
| JP | 2005-166306 | 6/2005 |
| JP | 2006-108526 | 4/2006 |
| KR | 10-0413396 | 11/2001 |
| WO | 2005/051043 | 6/2006 |

* cited by examiner

HEATING UNIT AND HEATING APPARATUS

BACKGROUND OF THE INVENTION

The present invention relates to a heating unit being used as a heat source and to a heating apparatus that uses the heating unit, such as electric heaters, cookers, driers and electronic apparatuses (including copying machines, facsimile machines and printers), and more particularly, to a heating unit that uses a carbonaceous substance as a heating element and has excellent heating characteristics as a heat source and to a heating apparatus that uses the heating unit.

Conventional heating units are configured such that a metallic electric heating wire formed of a tungsten wire or the like and formed into a coil shape or a heating element formed into a bar shape or a plate shape is provided inside a glass tube (for example, refer to Japanese Patent Application Laid-Open No. 2001-155692 (see pages 4 to 6, FIG. 7)).

The conventional heating units configured as described above are used as the heat sources of heating apparatuses, such as electric heaters, cookers, driers, copying machines, facsimile machines and printers, and in recent years they are used for various applications as small and efficient heating apparatuses (for example, refer to Japanese Patent Application Laid-Open No. 2003-400267).

Hence, in the case that such a heating unit is incorporated as the heat source of a heating apparatus, such as a cooker, oil and salt scattered from an object to be heated adhere to the heating unit, and contaminants and the like present in the usage environment also adhere thereto, thereby shortening the service life of the heating unit. For this reason, a heat source being long in service life in such harsh usage environment, small in size and high in efficiency, and high in versatility so as to be easily adaptable to various applications has been required. In the field of using such a heat source, providing a heating unit that satisfies the above-mentioned requirements and a heating apparatus that uses such a heating unit has been an important problem.

SUMMARY OF THE INVENTION

For the purpose of solving the above-mentioned problem, the present invention is intended to provide a heating unit serving as a heat source and being long in service life, small in size, high in efficiency, and high in versatility so as to be easily adaptable to various applications, and to provide a heating apparatus that uses the heating unit.

A heating unit according to a first aspect of the present invention comprises:

a heating element structure having a heating element, a first diathermanous tube incorporating the heating element structure, a second diathermanous tube incorporating the first diathermanous tube and disposed so as to have a predetermined clearance from the outer circumferential face of the first diathermanous tube, and caps for hermetically sealing the space formed by the clearance between the first diathermanous tube and the second diathermanous tube. Because the heating unit according to the first aspect of the present invention configured as described above is provided with the caps, the space formed by the clearance between the first diathermanous tube and the second diathermanous tube is hermetically sealed, and the first diathermanous tube is protected securely; hence, the contamination of the first diathermanous tube owing to usage environment can be prevented, the service life of the heating unit can be extended, and the size thereof can be made small.

A heating unit according to a second aspect of the present invention comprises:

a heating element structure having a heating element, a first diathermanous tube incorporating the heating element structure, a second diathermanous tube incorporating the first diathermanous tube and disposed so as to have a predetermined clearance from the outer circumferential face of the first diathermanous tube, and spacers for determining the clearance between the first diathermanous tube and the second diathermanous tube. Because the heating unit according to the second aspect of the present invention configured as described above is provided with the spacers, the clearance between the first diathermanous tube and the second diathermanous tube can be maintained securely, breakage prevention and efficient heat radiation of the first diathermanous tube can be attained; hence, the heating unit can have an extended service life and can be downsized.

A heating unit according to a third aspect of the present invention comprises:

a heating element structure having a heating element, a first diathermanous tube incorporating the heating element structure, a second diathermanous tube incorporating the first diathermanous tube and disposed so as to have a predetermined clearance from the outer circumferential face of the first diathermanous tube, spacers for determining the clearance between the first diathermanous tube and the second diathermanous tube, and caps for hermetically sealing the space formed by the clearance between the first diathermanous tube and the second diathermanous tube. Because the heating unit according to the third aspect of the present invention configured as described above is provided with the caps and the spacers, the first diathermanous tube can be protected securely, breakage prevention and efficient heat radiation of the first diathermanous tube can be attained; hence, the heating unit can have an extended service life and can be downsized.

A heating unit according to a fourth aspect of the present invention is the heating unit according to the first aspect described above, wherein reflective means is disposed in the clearance between the first diathermanous tube and the second diathermanous tube, and the reflective face of the reflective means is disposed as opposed to the heating element. In the heating unit according to the fourth aspect of the present invention configured as described above, the directivity of heat radiation from the heating element can be raised, the contamination of the reflective means can be prevented, and a highly efficient. heating state can be maintained.

A heating unit according to a fifth aspect of the present invention is the heating unit according to the fourth aspect described above, wherein the first diathermanous tube is formed of a glass tube hermetically incorporating the heating element structure, and the second diathermanous tube is formed of a cylindrical glass tube incorporating the first diathermanous tube. The heating unit according to the fifth aspect of the present invention configured as described above can carry out heat radiation from the heating element efficiently.

A heating unit according to a sixth aspect of the present invention is the heating unit according to the fourth aspect described above, wherein the second diathermanous tube is formed of a tube made of an inorganic material having thermal resistance, at least one selected from among a silica glass tube, a high-silica glass tube, a low-alkali borosilicate glass tube, a crystallized glass tube and a ceramic tube. In the heating unit according to the sixth aspect of the present invention configured as described above, the second diathermanous tube is not broken even if an abrupt temperature change occurs; and even in the case that alkali ion metals are used in the usage environment, a stable configuration can be obtained; hence, it is possible to provide a heating unit having a long service life.

A heating unit according to a seventh aspect of the present invention is the heating unit according to the fourth aspect described above, wherein the heating element structure comprises the heating element, lead wires extended from both ends of the first diathermanous tube, and heating element holding means for connecting the heating element to the lead wires, and the heating element is hermetically incorporated in the first diathermanous tube. The heating unit according to the seventh aspect of the present invention configured as described above can be made of a heating element material that is oxidized at high temperatures; hence, quick response can be attained, and thermal conduction and the like can be controlled using a gas sealed therein.

A heating unit according to an eighth aspect of the present invention is the heating unit according to the fourth aspect described above, wherein the reflective means is formed of a metal film. The heating unit according to the eighth aspect of the present invention configured as described above can carry out heat radiation from the heating element efficiently.

A heating unit according to a ninth aspect of the present invention is the heating unit according to the fourth aspect described above, wherein the reflective means is formed of a metal film made of nickel, ferritic stainless steel or nichrome. In the heating unit according to the ninth aspect of the present invention configured as described above, because the reflective means has thermal resistance and high reflectivity, oxidation does not occur even at high temperatures, high radiation efficiency can be maintained, and highly efficient heat radiation can be carried out.

A heating unit according to a tenth aspect of the present invention is the heating unit according to the fourth aspect described above, wherein the heating element is a carbonaceous heating element formed by firing. In the heating unit according to the tenth aspect of the present invention configured as described above, the material of the heating element includes a carbonaceous substance, and the emissivity of the carbonaceous heating element formed by firing is higher than that of a metallic heating element by 80% or more. The heating element made of such a material has higher primary radiation and a large amount of heat radiation is emitted to an object to be heated; hence, a heating unit having high radiation efficiency can be configured.

A heating unit according to an 11th aspect of the present invention is the heating unit according to the fourth aspect described above, wherein the heating element is a plate-like carbonaceous heating element configured so as to include a carbonaceous substance and a resistance adjustment substance and formed by firing. In the heating unit according to the 11th aspect of the present invention configured as described above, the heating element is made of materials including a carbonaceous substance and a resistance adjustment substance and formed by firing; hence, the emissivity of the heating element is higher than that of a metallic heating element by 80% or more. The heating element made of such materials has higher primary radiation and a large amount of heat radiation is emitted to an object to be heated; hence, a heating unit having high radiation efficiency can be configured. In addition, the specific resistivity value of the heating element configured as described above can be changed as desired, the heating element can be downsized so as to be adapted for various sizes, and the resistance change ratio depending on temperature can be changed from negative to positive values; hence, the stability of the heating element can be obtained securely.

A heating unit according to a 12th aspect of the present invention is the heating unit according to the fourth aspect described above, wherein the heating element is a strip-shaped carbonaceous heating element configured so as to include carbonaceous fiber. In the heating unit according to the 12th aspect of the present invention configured as described above, the heating element is configured so as to include carbonaceous fiber; hence, the configuration is strong against vibration, such as impact or the like.

A heating unit according to a 13th aspect of the present invention is the heating unit according to the 11th aspect described above, wherein the heating element has a substantially plate-like shape, the width of which is five or more times larger than the thickness thereof, and the face constituting the width of the heating element is a substantially flat face. In the heating unit according to the 13th aspect of the present invention configured as described above, the heating element itself can carry out heat radiation having directivity, and the heating element made of the materials described above is formed to have a flat face; hence, high directivity can be provided, and an object to be heated can be securely radiated by the primary radiation from the heating element; therefore, it is possible to configure a heating unit having high radiation efficiency.

A heating unit according to a 14th aspect of the present invention is the heating unit according to the fourth aspect described above, wherein the heating element has a substantially plate-like shape, the width of which is five or more times larger than the thickness thereof, and the reflective face of the reflective means is disposed as opposed to the substantially flat face constituting the width of the heating element. In the heating unit according to the 14th aspect of the present invention configured as described above, the heating element itself can carry out heat radiation having directivity; furthermore, higher directivity can be provided by disposing the reflective face as opposed to the flat face. Moreover, secondary radiation from the reflective means can be added to the primary radiation from the heating element, and heat can be radiated more securely to an object to be heated; therefore, it is possible to configure a heating unit having high radiation efficiency.

A heating unit according to a 15th aspect of the present invention is the heating unit according to the fourth aspect described above, wherein the heating element has a substantially plate-like shape, the width of which is five or more times larger than the thickness thereof, and the reflective face of the reflective means is disposed in orthogonal with the substantially flat face constituting the width of the heating element. In the heating unit according to the 15th aspect of the present invention configured as described above, the heating element itself can carry out heat radiation having directivity; furthermore, the heating unit can have higher directivity by disposing the reflective face in orthogonal with the flat face of the heating element. Moreover, secondary radiation from the reflective means can be added to the primary radiation from the heating element, and an object to be heated can be radiated more uniformly; therefore, it is possible to provide a heating unit having a wide radiation range and high radiation efficiency.

A heating unit according to a 16th aspect of the present invention is the heating unit according to the first aspect described above, wherein the caps is composed of fixing rings and binder for holding the clearance between the first diathermanous tube and the second diathermanous tube, and for hermetically sealing a space having the clearance between the first diathermanous tube and the second diathermanous tube. The heating unit according to the 16th aspect of the present invention configured as described above has the high heat resistance and the high hermetic; hence, the heating unit can operates with a high degree of reliability.

A heating unit according to a 17th aspect of the present invention is the heating unit according to the 16th aspect described above, wherein reflective means is disposed in the clearance between the first diathermanous tube and the second diathermanous tube, and the reflective face of the reflective means is disposed as opposed to the heating element. In the heating unit according to the 17th aspect of the present invention configured as described above, the directivity of heat radiation from the heating element can be raised, the contamination of the reflective means can be prevented, and a highly efficient heating state can be maintained.

A heating unit according to a 18th aspect of the present invention is the heating unit according to the 16th aspect described above, wherein the fixing ring is formed by ceramic material. In the heating unit according to the 18th aspect of the present invention configured as described above, the fixing ring can be formed by the high heat resistance material; hence, it is possible to provide a heating unit having a long service life.

A heating unit according to a 19th aspect of the present invention is the heating unit according to the 16th aspect described above, wherein the binder is composed of an inorganic thermal-resistant adhesive. In the heating unit according to the 19th aspect of the present invention configured as described above, the heating unit can be constructed with the high hermetic; hence, it is possible to provide a heating unit having a long service life.

A heating apparatus according to a 20th aspect of the present invention comprises:

the heating unit according to the seventh aspect described above, a power supply circuit connected to the lead wires of the heating unit, and a housing for holding the heating unit in a liquid-tight state and for isolating the lead wires from a heating area. In the heating apparatus according to the 20th aspect of the present invention configured as described above, because the lead wires are isolated from the heating area, the service life of the heating unit can be extended.

A heating apparatus according to a 21st aspect of the present invention is the heating apparatus according to the 20th aspect described above, wherein reflective means is disposed as opposed to the heating element in the heating area of the housing. In the heating apparatus according to the 21st aspect of the present invention configured as described above, the secondary radiation from the heating unit can be fully used for heat radiation of the object to be heated using the reflective means; hence, a heating apparatus having high radiation efficiency can be obtained.

A heating apparatus according to an 22nd aspect of the present invention is the heating apparatus according to the 20th aspect described above, wherein a control circuit for controlling the heating of the heating unit is provided, and the control circuit is configured using respective circuits for ON/OFF control, power supply ratio control, phase control and zero-cross control, singularly or in combination of at least two. In the heating apparatus according to the 22nd aspect of the present invention configured as described above, the control circuit is configured using respective circuits for ON/OFF control, power supply ratio control, phase control and zero-cross control, singularly or in combination of at least two; hence, the heating apparatus can carry out highly accurate temperature control. Furthermore, because an object to be heated can be heated properly at a desired temperature, the temperature of the heating element and the temperature of the object to be heated can be controlled accurately, and input of extra energy can be prevented; hence, it is possible to construct a heating apparatus having high efficiency and capable of attaining energy saving.

The present invention can provide a heating unit serving as a heat source and being long in service life, small in size, high in efficiency, and high in versatility so as to be easily adaptable to various applications, and can also provide a heating apparatus that uses the heating unit.

DETAILED DESCRIPTION OF THE PREFERRED EMBODIMENTS

Preferred embodiments of a heating unit and a heating apparatus that uses the heating unit according to the present invention will be described below referring to the accompanying drawings.

Embodiment 1

Figure 1:
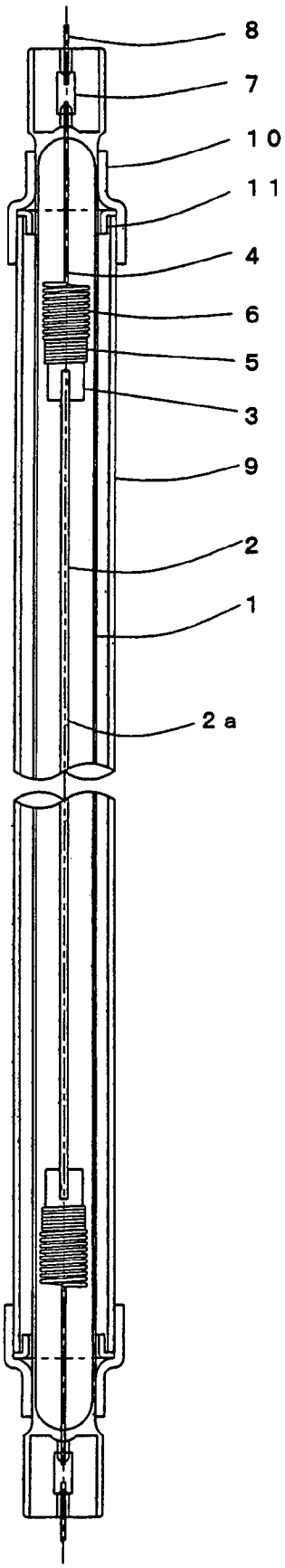
FIG. 1 is a cross-sectional view showing the structure of a heating unit according to Embodiment 1 of the present invention.
Figure 2:
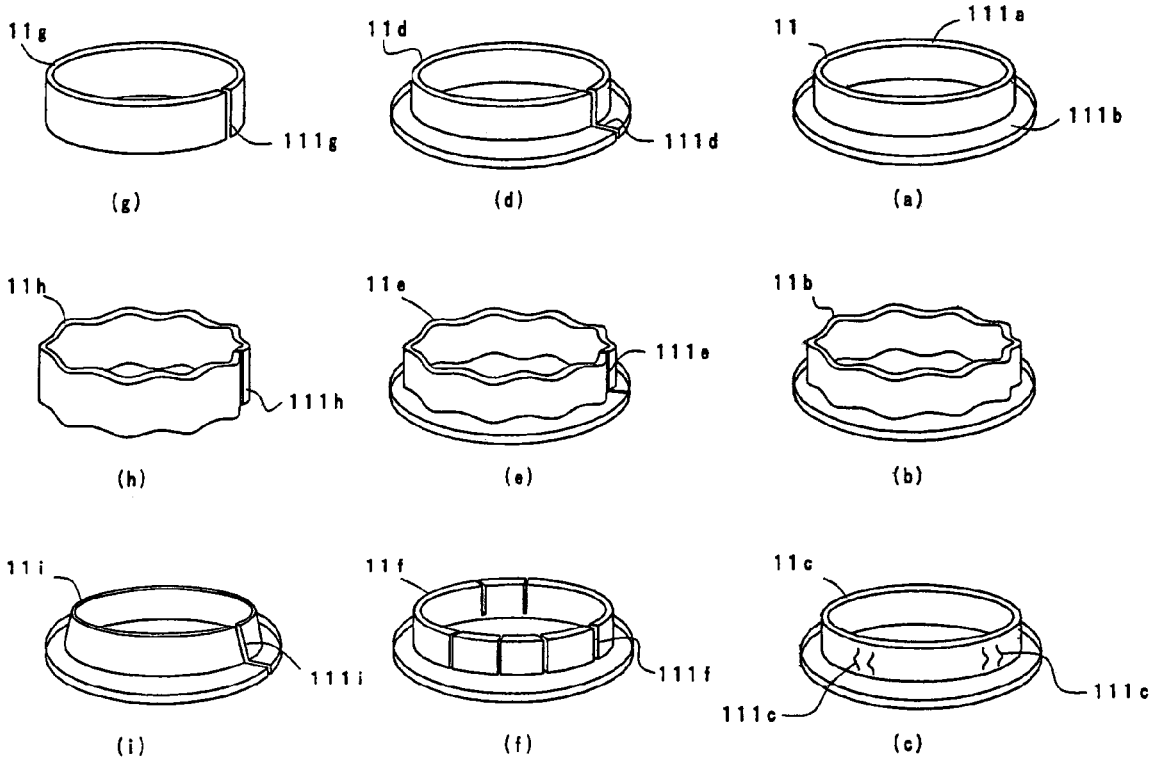
FIG. 2 is a perspective view showing the shapes of spacers in the heating unit according to Embodiment 1 of the present invention.

FIGS. 1 and 2 are views showing the configuration of a heating unit and its components according to Embodiment 1 of the present invention. FIG. 1 is a front view showing the structure of the heating unit according to Embodiment 1. FIG. 2 is a view showing the shapes of spacers serving as means for providing a clearance in the heating unit according to Embodiment 1.

The heating unit according to Embodiment 1 has a configuration wherein a heating element structure 2 having a heating element 2*a* serving as a heat source is incorporated in dual diathermanous tubes. In the heating unit according to Embodiment 1, a first diathermanous tube is a first glass tube 1 formed of a silica glass tube. Inside the first glass tube 1, the heating element structure 2 is disposed, and both ends of the first glass tube 1 are melted, flattened and sealed. An inert gas, such as argon, or a mixed gas of argon and nitrogen is sealed inside the first glass tube 1. The heating element structure 2 comprises a heating element 2*a* having a long and nearly flat plate shape and serving as a heat radiator, holding sections 3 secured to both ends of this heating element 2*a*, coil sections 5 installed at the external ends of the holding sections 3, spring sections 6 connected to the coil sections 5, internal lead wires 4 integrated with the spring sections 6, external lead wires 8 extending from both ends of the first glass tube 1, and molybdenum foils 7 that electrically connect the internal lead wires 4 to the external lead wires 8. The molybdenum foil 7 is embedded in a sealed portion formed at each of both ends of the first glass tube 1. Heating element holding means comprises the holding section 3, the coil section 5 and the spring section 6. In addition, a lead wire section comprises the internal lead wire 4, the molybdenum foil 7 and the external lead wire 8.

The heating element 2*a* in the heating unit according to Embodiment 1 is made of a carbonaceous substance formed into a long flat plate shape, which is composed of a mixture obtained by adding a nitrogen compound serving as a resistance value adjustment substance and amorphous carbon to the base material of crystallized carbon, such as graphite. The dimensions of the heating element 2*a* are as follows: the plate width T is 6.0 mm, the plate thickness t is 0.5 mm, and the length L is 300 mm, for example. It is desirable that the ratio (T/t) of the plate width T and the plate thickness t in the heating element 2*a* should be 5 or more, that is, the plate width T should be five or more times larger than the plate thickness t. When the heating element is formed into a flat plate shape in which the plate width T is five or more times larger than the plate thickness t, the amount of heat radiated from the wide flat face (the face constituting the plate width T) is made larger than the amount of heat radiated from the narrow side face (the face constituting the plate thickness t), and the heat radiation from the heating element 2*a* having a flat plate shape can be provided with directivity.

As shown in FIG. 1, one end of the heating element 2*a* is secured to one end of the holding section 3 of the heating element structure 2, and the coil section 5 is wound tightly around the other end of the holding section 3. The coil section 5, the spring section 6 and the internal lead wire 4 are integrally formed of a molybdenum wire. In Embodiment 1, an example in which the coil section 5, the spring section 6 and the internal lead wire 4 are formed of a molybdenum wire is described; however, they may be formed of a metallic wire having elasticity, such as a tungsten wire, instead of a molybdenum wire. The coil section 5 is wound tightly and spirally on the outer circumferential face of the holding section 3, whereby the coil section 5 is connected electrically and securely to the holding section 3. The spring section 6 formed into a spiral shape and having an elastic force provides tension to the heating element 2*a*; as a result, the heating element 2*a* is disposed at a desired position inside the first glass tube 1 at all times. Because the spring section 6 is provided between the internal lead wire 4 and the coil section 5, it is possible to absorb dimensional changes owing to the thermal expansion of the heating element 2*a*.

In the heating unit according to Embodiment 1, an example wherein the spring section 6 is provided at each of both ends of the heating element 2*a* is described; however, it is needless to say that a configuration wherein the spring section 6 is provided at only one end of the heating element 2*a* can be used.

The internal lead wire 4 is joined near one end of the molybdenum foil 7 by welding, and the external lead wire 8 that supplies a power supply voltage to the heating element structure 2 is joined near the other end of the molybdenum foil 7 by welding.

The heating element 2*a* configured as described above is disposed at a desired position inside the first glass tube 1, and the molybdenum foil 7 for connecting the internal lead wire 4 to the external lead wire 8 is embedded in the flattened and sealed portion of the first glass tube 1. The inert gas, such as argon, or the mixed gas of argon and nitrogen, sealed inside the first glass tube 1 is used to prevent the oxidation of the heating element 2*a* made of a carbonaceous substance.

The first glass tube 1 incorporating the heating element structure 2 configured as described above is disposed inside a second glass tube 9 serving as a second diathermanous tube having a cylindrical shape, with a predetermined clearance formed therebetween. Spacers 11 are provided so that the first glass tube 1 is disposed inside the second glass tube 9, with the predetermined clearance formed therebetween. The spacer 11 according to Embodiment 1 is shown in (a) of FIG. 2. As shown in (a) of FIG. 2, the spacer 11 is configured so as to have a cylindrical section 111*a* and a flange section 111*b*. The cylindrical section 111*a* is disposed between the first glass tube 1 and the second glass tube 9, and the predetermined clearance (space) is formed between the first glass tube 1 and the second glass tube 9. The flange section 111*b* is engaged with the end of the second glass tube 9 and is used to position the spacer 11. The spacer 11 according to Embodiment 1 is made of a metal having high thermal conductivity, such as aluminum or brass. By the use of such a material having high thermal conductivity, thermal conduction to both ends of the heating unit is shut off; hence, the reliability of an apparatus that uses the heating unit can be raised. Furthermore, by the use of stainless steel having high thermal resistance as the material of the spacer 11, the spacer can cope with high temperatures.

In the heating unit according to Embodiment 1, an example wherein the spacer 11 shown in (a) of FIG. 2 is used is described; however, the configuration of the spacer is formed into various shapes, and examples of the shapes are shown in (b) to (i) of FIG. 2.

In the spacer 11*b* shown in (b) of FIG. 2, a corrugated uneven face is formed on the cylindrical section. Because the uneven face is formed on the cylindrical section as described above, a clearance larger than the plate thickness of the cylindrical section can be formed between the first glass tube 1 and the second glass tube 9.

In the spacer 11*c* shown in (c) of FIG. 2, multiple protrusions 111*c* are formed on the cylindrical section. The protrusions 111*c* are disposed on the outer circumferential face of the cylindrical section at constant intervals. Because the protrusions 111*c* are formed on the cylindrical section as described above, a clearance larger than the plate thickness of the cylindrical section can be formed securely between the first glass tube 1 and the second glass tube 9.

In the spacer 11*d* shown in (d) of FIG. 2, a cut-off portion 111*d* is formed in the cylindrical section and the flange section, and the diameter of the spacer 11*d* formed into a substantially circular shape is variable. The spacer 11*d* is made of a metallic material having elasticity, and is deformed depending on the diameter of the first glass tube 1 on which the spacer is installed, thereby holding the outer circumferential face thereof. Hence, the spacer 11*d* can be adapted to the first glass tube 1 having a different diameter, and can be used for heating units having various configurations.

In the spacer 11*e* shown in (e) of FIG. 2, a cut-off portion 111*e* is formed in the cylindrical section and the flange section, and the diameter of the spacer 11*e* formed into a substantially circular shape is variable. The spacer 11*e* is made of a metallic material having elasticity, and is deformed depending on the diameter of the first glass tube 1 on which the spacer is installed, thereby holding the outer circumferential face thereof. Furthermore, because a corrugated uneven face is formed on the cylindrical section, a clearance larger than the plate thickness of the cylindrical section can be formed between the first glass tube 1 and the second glass tube 9.

In the spacer 11*f* shown in (f) of FIG. 2, multiple slits are formed in the cylindrical section, and the diameter of the cylindrical section of the spacer 11*f* formed into a substantially circular shape is variable. The spacer 11*f* is made of a metallic material having elasticity, and is deformed depending on the diameter of the first glass tube 1 on which the spacer is installed, thereby holding the outer circumferential face thereof. Hence, the spacer 11*f* can be adapted easily to the first glass tube 1 having a different diameter only by simply insertion.

The spacer 11*g* shown in (g) of FIG. 2 has no flange section but is composed of only the cylindrical section, and a cut-off portion 111*g* is formed in the cylindrical section. The spacer 11*g* is made of a metallic material having elasticity, and is configured so as to hold the outer circumferential face of the first glass tube 1 on which the spacer is installed. Hence, the spacer 11*g* can be adapted to the first glass tube 1 having a different diameter, and can be installed easily.

The spacer 11*h* shown in (h) of FIG. 2 has no flange section but is composed of only the cylindrical section, and an uneven face is formed on the cylindrical section, and a cut-off portion 111*h* is formed in the cylindrical section. The spacer 11*h* is made of a metallic material having elasticity, and is configured so as to hold the outer circumferential face of the first glass tube 1 on which the spacer is installed. Hence, the spacer 11*h* can be adapted to the first glass tube 1 having a different diameter, and a clearance larger than the plate thickness of the cylindrical section can be formed between the first glass tube 1 and the second glass tube 9.

In the spacer 11*i* shown in (i) of FIG. 2, a cut-off portion 11*i* is formed in the cylindrical section and the flange section, and the diameter of the spacer 11*i* formed into a substantially circular shape is variable. The spacer 11*i* is made of a metallic material having elasticity, and is deformed depending on the diameter of the first glass tube 1 on which the spacer is installed, thereby holding the outer circumferential face thereof. Furthermore, the cylindrical section of the spacer 11*i* has a tapered shape (a shape tapered upward in (i) of FIG. 2), and a clearance larger than the plate thickness of the cylindrical section can be formed between the first glass tube 1 and the second glass tube 9.

In the heating unit according to Embodiment 1, a cap 10 for hermetically sealing the clearance (space) between the first glass tube 1 and the second glass tube 9 is provided. The cap 10 is made of rubber having elasticity and is disposed so as to cover the spacer 11 described above. In other words, the cap 10 is provided to cover the spacer 11 provided at each of both ends of the second glass tube 9 and to secure the second glass tube 9 to the first glass tube 1.

In Embodiment 1, the cap 10 is made of silicone rubber having thermal resistance and thermal shrinkability and formed into a tubular shape to ensure tight contact between the first glass tube 1 and the second glass tube 9. Even if a cap made of a fluororesin having thermal resistance and formed into a tubular shape, instead of silicone rubber that is easy to mold, is used as the cap 10, the clearance between the first glass tube 1 and the second glass tube 9 can be sealed hermetically. Furthermore, it is also possible to have a configuration wherein a cap made of a metal and formed into a tubular shape, instead of a resin, can be used as the cap 10, and the cap is crimped at each of both ends of the second glass tube 9 to attain hermetic sealing. It is preferable that a soft metal that can be crimped, such as aluminum or brass, should be used as the cap 10 made of a metal.

In the heating unit according to Embodiment 1, the spacer 11 for determining the clearance between the first glass tube 1 and the second glass tube 9 is made of a material having thermal conductivity, and has a function of dispersing the heat radiated from the heating element 2*a* and conducted to the first glass tube 1. Because the spacer 11 carries out heat dispersion as described above, the thermal conduction to the cap 10 is shut off to some extent; with this configuration, the cap 10 is prevented from being heated to high temperatures. Hence, in the case that the heating unit configured as described above is incorporated as a heat source in an apparatus, an apparatus having high reliability can be constructed by using a structure in which the caps 10 are installed in the housing of the apparatus.

As described above, in the heating unit according to Embodiment 1 shown in FIG. 1, the spacer 11 is provided between the first glass tube 1 and the second glass tube 9 to form a desired clearance therebetween, and the cap 10 is provided to cover the position where the spacer 11 is disposed. In the case that the heating unit according to Embodiment 1 configured as described above is incorporated as a heat source in a heating apparatus, by the installation of the heating unit in the housing at the positions where the caps 10 are provided, contaminants generated in the heating area thereof during heating are prevented from flowing outside the heating area through between the housing and the heating unit. This can be attained easily by having a configuration wherein the space between the second glass tube 9 of the heating unit and the housing is clogged with the caps 10. Furthermore, by the use of a hermetically sealing member, such as a rubber bushing having thermal resistance and flexibility, at the portion where the heating unit is installed in the housing of the heating apparatus, contaminants generated in the heating area during heating are prevented securely from flowing outside the heating area.

Moreover, in the case that the heating unit according to Embodiment 1 is used in a heating apparatus, the first glass tube 1 is incorporated in the second glass tube 9, and the clearance therebetween is hermetically sealed using the caps 10; with this structure, the first glass tube 1 is protected against contaminants generated during heating using the second glass tube 9 and the caps 10, and its service life is extended.

A glass tube, such as a silica glass tube, is used for the first glass tube 1, because the glass tube is configured so that its sealed portions are formed by welding; if contaminants (alkali metals and the like) adhere to the glass tube configured as described above and if the glass tube is heated to high temperatures, a phenomenon referred to as devitrification occurs, causing a problem of breakage of the glass tube. However, in the heating unit according to Embodiment 1, the second glass tube 9 is provided so as to cover the first glass tube 1 with a predetermined clearance formed therebetween; hence, the temperature of the second glass tube 9 is lower than that of the first glass tube 1; with this configuration, the phenomenon referred to as devitrification is difficult to occur. Furthermore, by the use of crystallized glass as the material of the second glass tube 9, the phenomenon referred to as devitrification is further difficult to occur. As described above, the heating unit according to Embodiment 1 is configured so as to physically and securely prevent contaminants from entering the first glass tube 1 using the second glass tube 9 and the caps 10.

As the second glass tube 9, a tube selected, depending on the usage state, from among glass tubes having thermal resistance, such as a silica glass tube, a high-silica glass tube, a low-alkali borosilicate glass tube, a crystallized glass tube and a ceramic tube, can be used. Conditions that should be considered in the usage state are usage temperature, thermal transmittance, the degree of generation of alkali metals present as contaminants, strength, etc. The material of the second glass tube 9 is selected in consideration of these conditions.

The heating unit according to Embodiment 1 comprising the first glass tube 1 and the second glass tube 9 configured as described above and the heating unit comprising only the first glass tube 1 without using the second glass tube 9 were subjected to radiation intensity measurements. The first glass tube 1 formed of a silica glass and the second glass tube 9 formed of a crystallized glass were used for the measurements.

Figure 3:
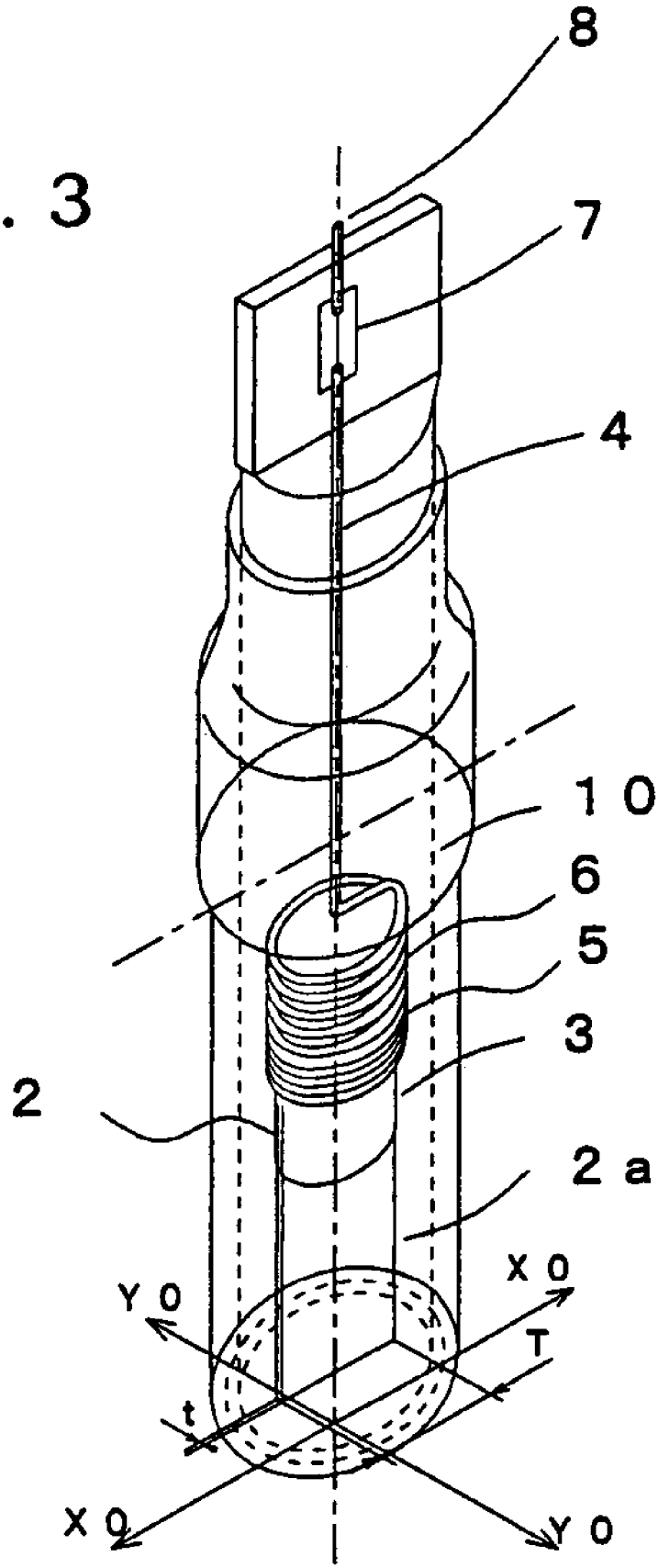
FIG. 3 is a partial perspective view showing the heating unit according to Embodiment 1 of the present invention.

FIG. 3 is a partial perspective view showing the vicinity of the end of the heating element 2*a* in the heating unit according to Embodiment 1; the first glass tube 1, the second glass tube 9 and the cap 10 are drawn as transparent components. In this partial perspective view, the direction of the width (T) of the heating element 2*a* having a long flat plate shape is represented by X0-X0, and the direction of the thickness (t) thereof is represented by Y0-Y0.

Figure 4:
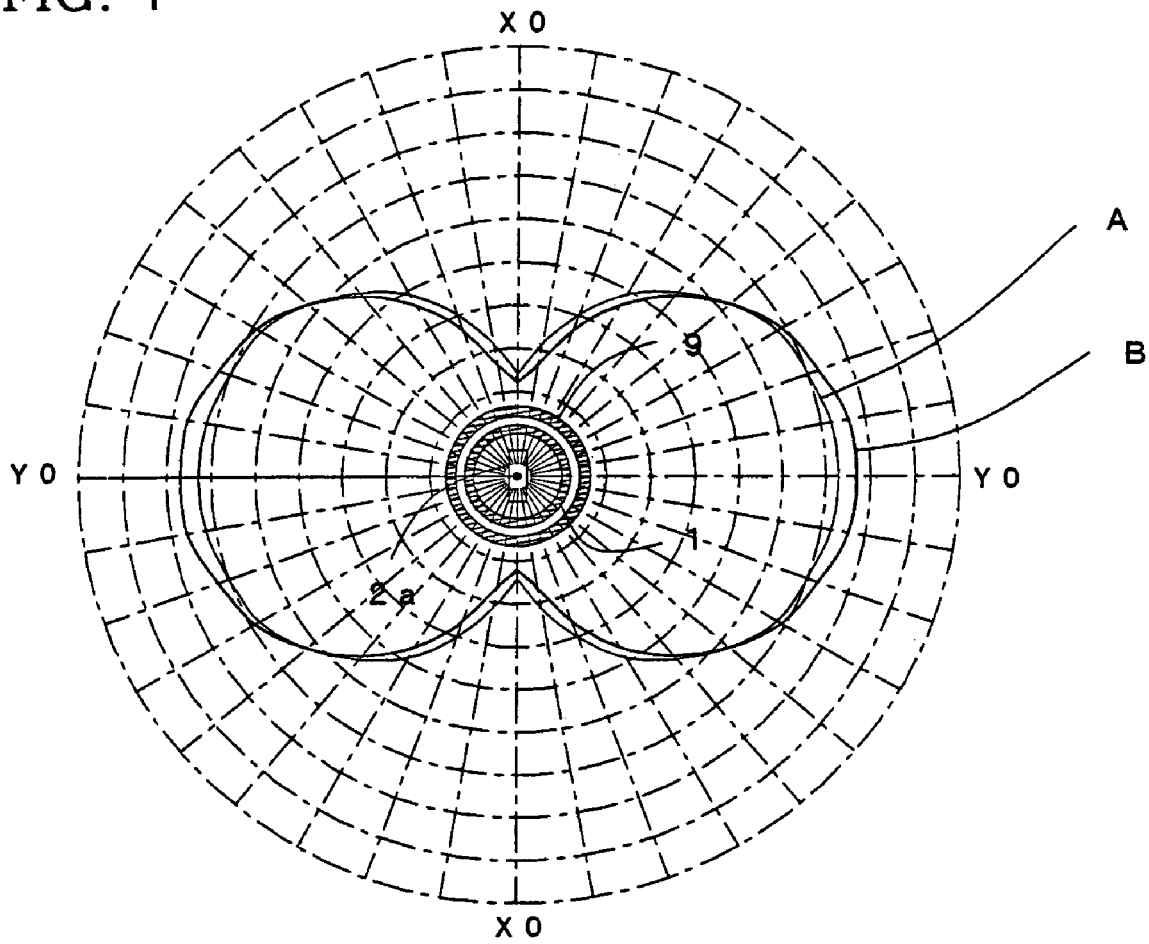
FIG. 4 is a view showing the radiation intensity curves of the heating unit according to Embodiment 1 of the present invention.

FIG. 4 shows the radiation intensity curve A of the heating unit according to Embodiment 1 comprising the first glass tube 1 and the second glass tube 9, and the radiation intensity curve B of the heating unit comprising only the first glass tube 1. In FIG. 4, the direction of the width shown in FIG. 3 is represented by X0-X0, and the direction of the thickness is represented by Y0-Y0.

As shown in FIG. 4, when the radiation intensity curve A of the heating unit according to Embodiment 1 comprising the first glass tube 1 and the second glass tube 9 is compared with the radiation intensity curve, B of the heating unit comprising only the first glass tube 1, the radiation lowers by approximately 5% because the second glass tube 9 made of crystallized glass is provided, but the directivity does not change significantly. Hence, even if the second glass tube 9 is used as the cover glass of the first glass tube 1, the configuration causes little influence.

In the heating unit according to Embodiment 1, a structure wherein the first glass tube 1 is sealed is described; however, in the case of this structure, the heating element 2*a* is made of a tungsten-based material, a molybdenum-based material, a carbonaceous material, or a material including a carbonaceous material and a resistance value adjustment agent, being oxidized at high temperatures in the air. However, in the case that the heating element is made of a silicon carbide-based material, a molybdenum disilicide-based material, a lanthanum chromite-based material, a nichrome-based material, or a stainless steel-based material, being usable in the air, it is needless to say that the sealed structure according to Embodiment 1 is not required.

As described above, in the heating unit according to Embodiment 1 of the present invention, because the first glass tube 1 is protected using the second glass tube 9, the caps 10 and the spacers 11, the service life of the heating element 2*a* can be extended. Therefore, in the heating unit according to Embodiment 1, the heating element 2*a* can be protected securely against contaminants generated during the heating of an object to be heated, and it is possible to provide a heating apparatus having a long service life.

Embodiment 2

Figure 5:
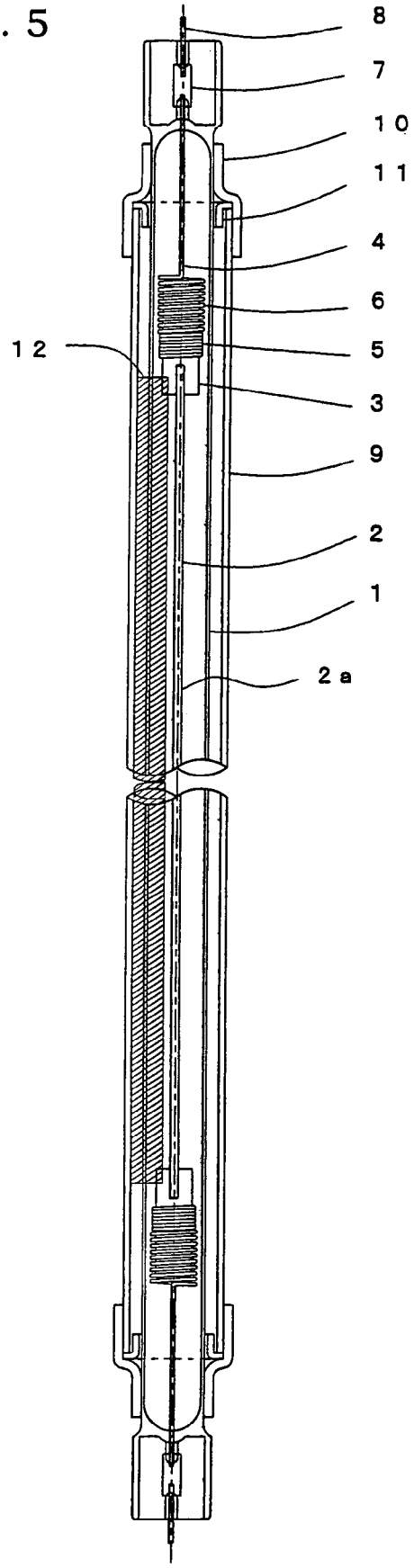
FIG. 5 is a cross-sectional view showing the structure of a heating unit according to Embodiment 2 of the present invention.
Figure 6:
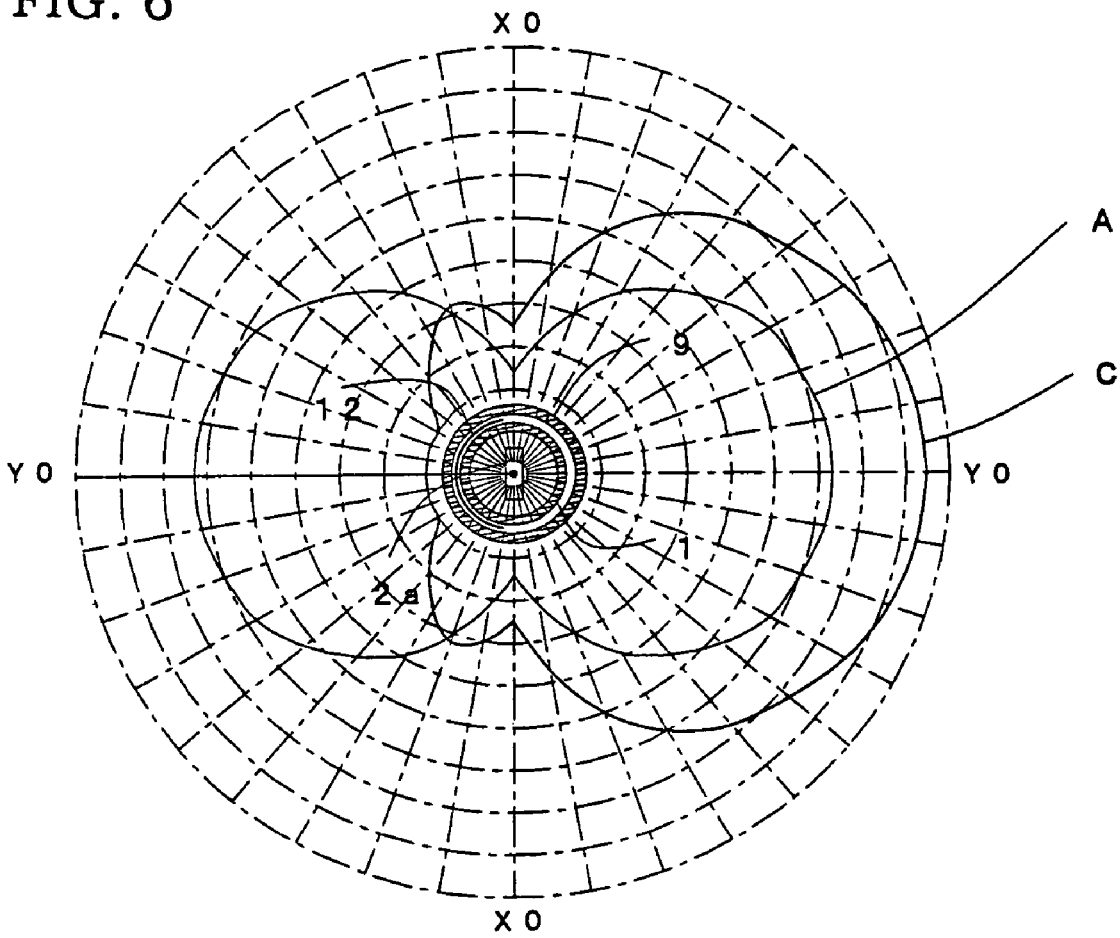
FIG. 6 is a view showing the radiation intensity curve of the heating unit according to Embodiment 2 of the present invention, a reflective sheet being disposed as opposed to the width direction of the heating element thereof.
Figure 7:
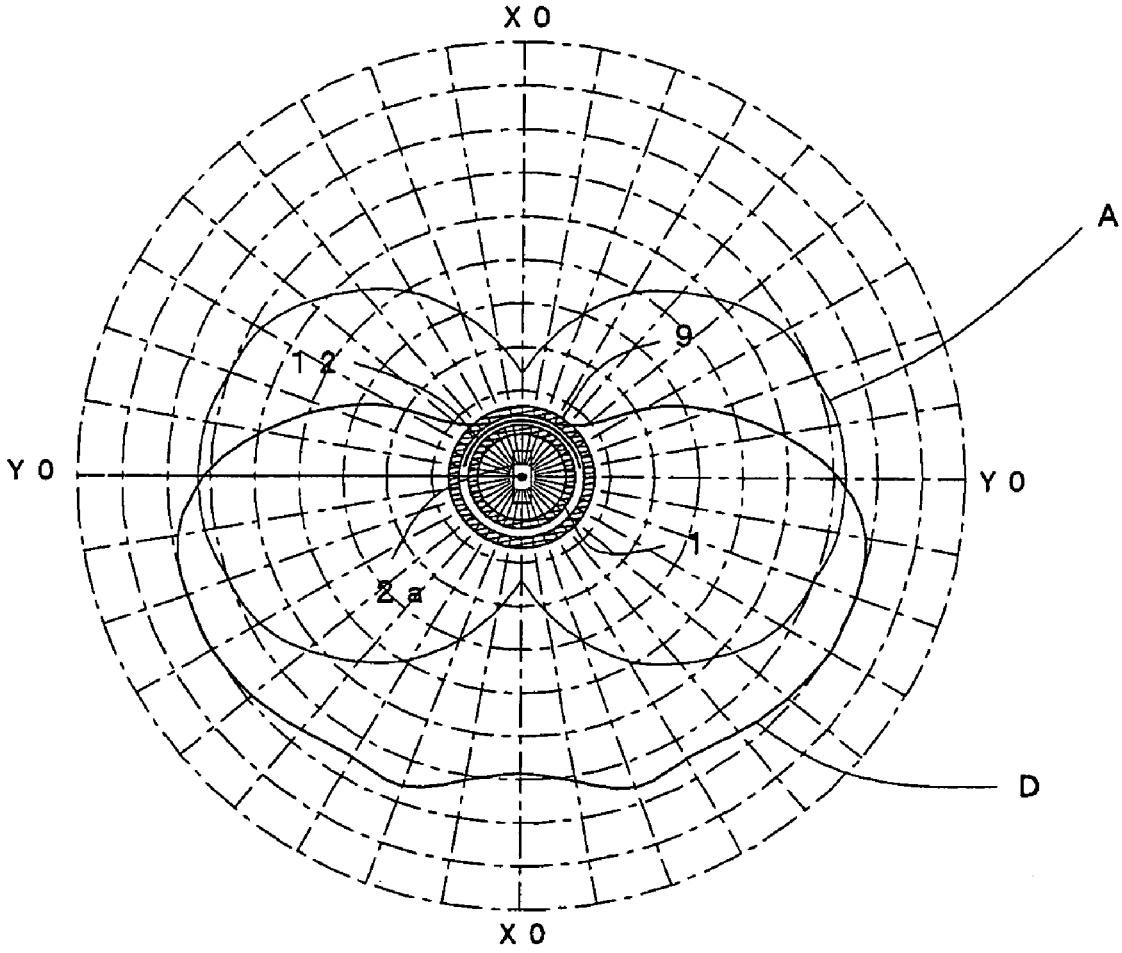
FIG. 7 is a view showing the radiation intensity curve of the heating unit according to Embodiment 2 of the present invention, a reflective sheet being disposed as opposed to the thickness direction of the heating element thereof.

A heating unit according to Embodiment 2 of the present invention will be described below using the accompanying drawings, FIGS. 5 to 7. FIG. 5 is a front view showing the structure of the heating unit according to Embodiment 2. FIG. 6 is a graph showing a radiation intensity curve in the cross-sectional direction of the heating unit being configured so that a reflective sheet 12 formed of a film according to Embodiment 2 is disposed as opposed to the flat face of the heating element 2*a* in parallel with the width direction (the X0-X0 direction) thereof. Furthermore, FIG. 7 is a graph showing a radiation intensity curve in the cross-sectional direction of the heating unit being configured so that the reflective sheet 12 according to Embodiment 2 is disposed as opposed to the face of the heating element 2*a* in parallel with the thickness direction (the Y0-Y0 direction) thereof.

The configuration of the heating unit according to Embodiment 2 differs from that of the heating unit according to Embodiment 1 described above in that the reflective sheet 12 serving as a reflective means is formed between the first glass tube 1 and the second glass tube 9. The reflective sheet 12 is disposed at the position opposed to the heating element 2*a* incorporated in the first glass tube 1. In the descriptions and drawings according to Embodiment 2, the components having the same functions and configurations as those of the components according to Embodiment 1 are designated by the same numerals, and their descriptions are omitted. Furthermore, in Embodiment 2, the same components as those according to Embodiment 1 are made of the same materials.

Just as in the case of Embodiment 1, the heating element 2*a* in the heating unit according to Embodiment 2 is made of a carbonaceous substance formed into a long flat plate shape, which is composed of a mixture obtained by adding a nitrogen compound serving as a resistance value adjustment substance and amorphous carbon to the base material of crystallized carbon, such as graphite. The dimensions of the heating element 2*a* are as follows: the plate width T is 6.0 mm, the plate thickness t is 0.5 mm, and the length L is 300 mm, for example. It is desirable that the ratio (T/t) of the plate width T and the plate thickness t in the heating element 2 should be 5 or more. When the heating element is formed into a flat plate shape in which the plate width T is five or more times larger than the plate thickness t, the amount of heat radiated from the wide flat face (the face constituting the plate width T) is made larger than the amount of heat radiated from the narrow side face (the face constituting the plate thickness t), and the heat radiation from the heating element 2*a* having a flat plate shape can be provided with directivity.

The reflective sheet 12 being used in the heating unit according to Embodiment 2 is made of a material obtained by subjecting ferritic stainless steel having a plate thickness of 50 μm and being excellent in thermal resistance to a heat treatment (at 900 to 1000° C.) so that alumina is deposited on the surface so as to be difficult to discolor at high temperatures. The method for installing the reflective sheet 12 is described below: by disposing the reflective sheet 12 having a plate thickness of 50 μm and having elasticity and a small curvature into the curved clearance between the first glass tube 1 and the second glass tube 9, the reflective sheet 12 can be secured at a desired position between the first glass tube 1 and the second glass tube 9 owing to the difference between the curvatures of the clearance and the reflective sheet 12.

In Embodiment 2, the reflective sheet 12 is configured so as to be held between the first glass tube 1 and the second glass tube 9 as described above; however, in order to be disposed between the first glass tube 1 and the second glass tube 9, the reflective sheet 12 may be configured so that securing means, such as protrusions, for securing the reflective sheet 12 to the first glass tube 1 or the second glass tube 9 are provided, or securing means, such as bumps and dips, are provided on the reflective sheet 12 and either the first glass tube 1 or the second glass tube 9 so as to be fitted, depending on the material and shape of the reflective sheet 12. Furthermore, the reflective sheet 12 may be secured to the inner wall of the first glass tube 1 or the outer wall of the second glass tube 9; in this case, securing members should only be formed on the wall face corresponding thereto. Moreover, it may also be possible that the reflective sheet 12 is made of a reflective film that is formed by aluminum evaporation, gold transfer or the like. The effects of the present invention are not affected in any of the various configurations relating to the reflective sheet 12 described above.

The heating unit according to Embodiment 2 provided with the reflective sheet 12 configured as described above and the heating unit according to Embodiment 1 described above were subjected to radiation intensity measurements. The first glass tube 1 formed of a silica glass and the second glass tube 9 formed of a crystallized glass were used for the measurements. The heating element 2*a* used in the radiation intensity measurements is made of a carbonaceous substance formed into a long flat plate shape, which is composed of a mixture obtained by adding a nitrogen compound serving as a resistance value adjustment substance and amorphous carbon to the base material of crystallized carbon, such as graphite. The dimensions of the heating element 2*a* are as follows: the plate width T is 6.0 mm, the plate thickness t is 0.5 mm, and the length L is 300 mm.

FIG. 6 shows the cross-sectional radiation intensity curve A of the heating unit according to Embodiment 1 comprising the first glass tube 1 and the second glass tube 9, and the cross-sectional radiation intensity curve C of the heating unit according to Embodiment 2 wherein the reflective sheet 12 is disposed as opposed to the flat face of the heating element 2*a* in parallel with the width direction (the X0-X0 direction) thereof. As shown in FIG. 6, when the radiation intensity curve C, obtained from the configuration wherein the reflective sheet 12 is provided in the clearance between the second glass tube 9 and the first glass tube 1, and the reflective sheet 12 is disposed as opposed to the flat face of the heating element 2*a* in parallel with the width direction (the X0-X0 direction) thereof, is compared with the radiation intensity curve A obtained from the configuration according to Embodiment 1, the radiation intensity in one direction (the YO direction on the right side of FIG. 6) can be raised by 20 to 30%.

FIG. 7 shows the cross-sectional radiation intensity curve A of the heating unit according to Embodiment 1 comprising the first glass tube 1 and the second glass tube 9, and the cross-sectional radiation intensity curve D of the heating unit according to Embodiment 2 wherein the reflective sheet 12 is disposed as opposed to the flat face of the heating element 2*a* in parallel with the thickness direction (the Y0-Y0 direction) thereof. As shown in FIG. 7, in the heating unit according to Embodiment 2 wherein the reflective sheet 12 is disposed as opposed to the flat face of the heating element 2*a* in parallel with the thickness direction (the Y0-Y0 direction) thereof, the radiation intensity in the width (T) direction (the X0-X0 direction) of the heating element 2*a* can be raised, and heating can be attained in a wide range.

As described above, the directivity of the heating unit can be raised by installing the reflective sheet 12 in the heating unit configured such that the width of the heating element 2*a* is five or more times larger than the thickness, and a heating state suited for an object to be heated can be obtained.

The heating unit according to Embodiment 2 is described such that the heating element 2*a* has the shape of a plate having flat faces; however, the heating element 2*a* may have the shape of fiber, such as carbon fiber or the like, for example, the shape of a strip or the shape of a strip with slits; in such a case, effects similar to those of Embodiment 2 are obtained, provided that the heating element has a nearly flat face on average, even if the face is uneven.

in the heating unit according to Embodiment 2 shown in FIG. 5, the reflective sheet 12 is disposed in the clearance between the first glass tube 1 and the second glass tube 9, and the clearance is sealed using the caps 10. In the case that the heating unit according to Embodiment 2 is installed in a heating apparatus, for example, contaminants generated in the heating area during heating do not directly adhere to the reflective sheet 12; as a result, the reflective face of the reflective sheet 12 is not discolored, and high reflectivity can be maintained.

Although ferritic stainless steel is used for the reflective sheet 12 according to Embodiment 2, even if reflective sheet is configured using a metal material having high reflectivity and being difficult to discolor at high temperatures, such as nickel (Ni), chromium, gold, platinum or chromium alloy, similar effects are produced. Furthermore, in the case of a configuration wherein the reflective sheet is not heated to high temperatures, it is needless to say that similar effects are obtained even if aluminum (Al), aluminum alloy, general-purpose stainless steel, copper alloy or the like is used.

The heating unit according to Embodiment 2 has been described using the plate-shaped heating element having directivity; however, the directivity in one direction can be raised using the reflective sheet 12 for a heating element having no directivity, such as a heating element having a cylindrical shape, a round rod shape or a nearly rectangular shape, and the reflective sheet 12 and the first glass tube 1 can be protected against contaminants; hence, it is possible to provide a heating unit having a long service life.

As described above, with the heating unit according to Embodiment 2 of the present invention, the first glass tube 1 can be protected using the second glass tube 9, the caps 10 and the spacers 11, and the service life of the heating element 2*a* can be extended; furthermore, by the use of the reflective sheet 12 disposed in the clearance between the first glass tube 1 and the second glass tube 9, it is possible to provide a heating apparatus capable of raising the directivity while an object to be heated is heated and capable of protecting the reflective sheet 12.

Embodiment 3

Figure 8:
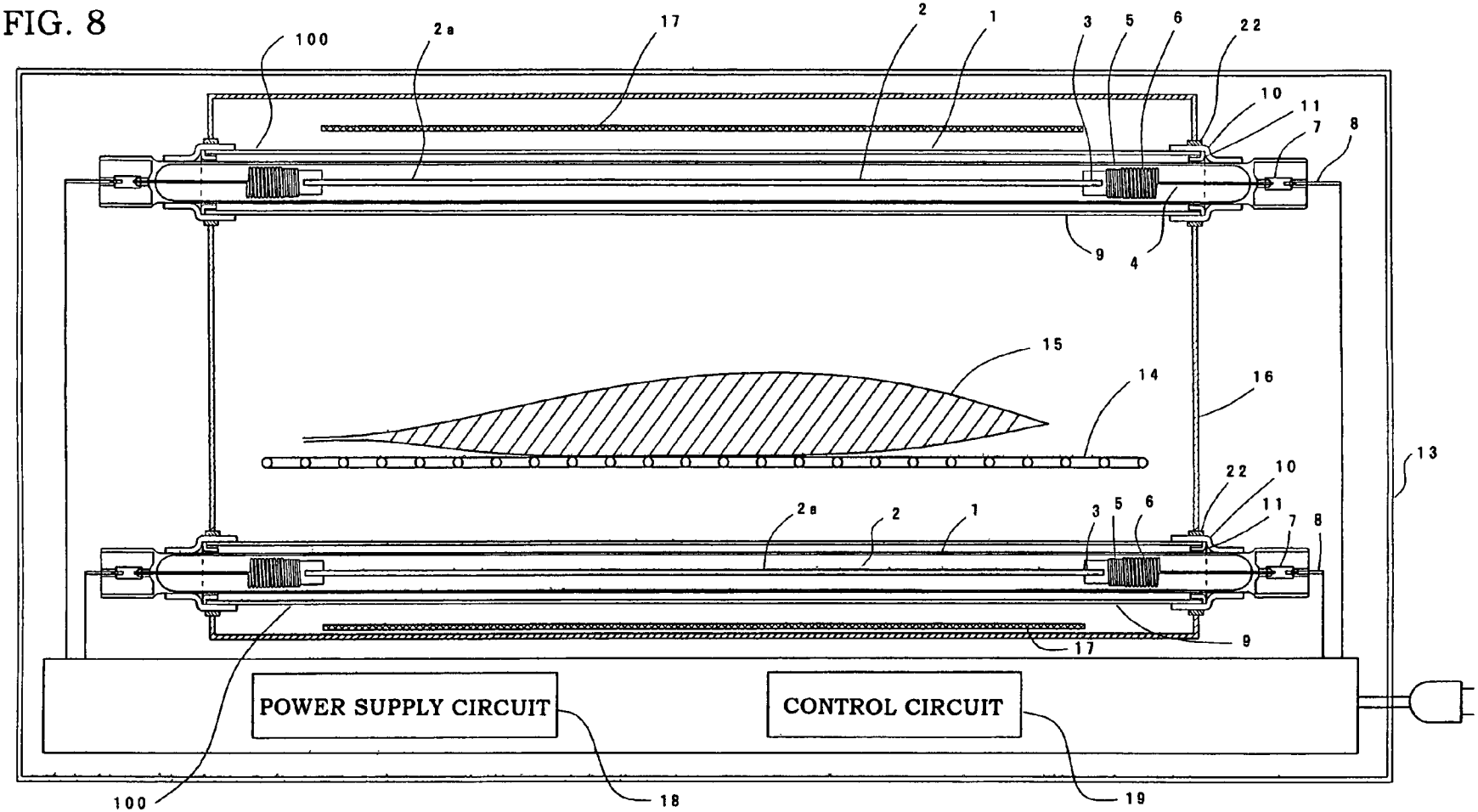
FIG. 8 is a view showing a first heating apparatus according to Embodiment 3 of the present invention.
Figure 9:
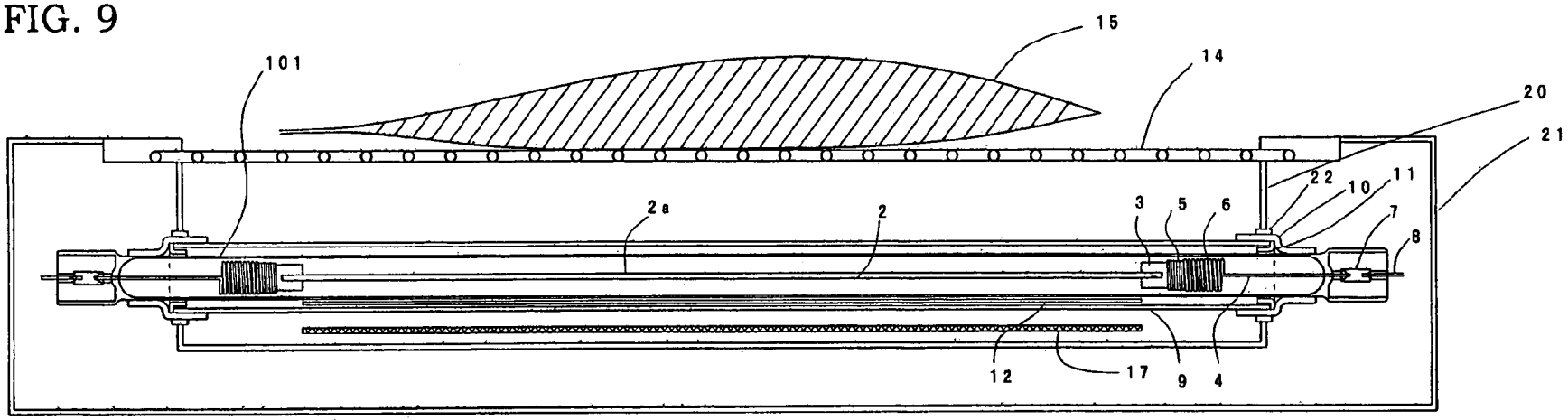
FIG. 9 is a view showing a second heating apparatus according to Embodiment 3 of the present invention.

Heating apparatuses according to Embodiment 3 of the present invention will be described below using the accompanying drawings, FIGS. 8 to 9. FIG. 8 is a cross-sectional view showing the structure of a first heating apparatus according to Embodiment 3. FIG. 9 is a cross-sectional view showing the structure of a second heating apparatus according to Embodiment 3.

The first heating apparatus according to Embodiment 3 is configured so that two heating units, each heating unit according to Embodiment 1 described above and being used as a heat radiation source, are disposed above and below an object to be heated. The second heating apparatus according to Embodiment 3 is configured so that one heating unit according to Embodiment 2 described above and being used as a heat unit is disposed below an object to be heated.

As shown in FIG. 8, in the first heating apparatus, the heating units described in Embodiment 1 are disposed above and below a wire net 14 on which an object to be heated is placed. Each heating unit 100 is secured to an inner housing 16, in which a heating area is formed, at the positions of the caps 10 provided on both ends thereof. Each cap 10 is tightly fitted in a hole formed in the inner housing 16 and secured thereto. It may also be possible that the heating units 100 are secured to the inner housing 16 using hermetically sealing members 22 having thermal resistance and flexibility, such as rubber bushings. By the use of the hermetically sealing members 22 as described above, the space inside the apparatus and between an outer housing 13 constituting the outer appearance of the heating apparatus and the inner housing 16 is securely isolated from the heating area in a liquid-tight state, preventing inflow of contaminants from the heating area.

The first heating apparatus shown in FIG. 8 is provided with reflective plates 17. The reflective plates 17 are disposed above the upper heating unit 100 and below the lower heating unit 100 so that the heat radiated from the rear side (the side not opposed to the wire net 14) of the heating element 2*a* of each heating unit 100 is reflected to an object 15 to be heated, which is placed on the wire net 14. In the first heating apparatus shown in FIG. 8, the reflective plates 17 are provided inside the inner housing 16 constituting the heating area, and the reflective plates 17 make it possible to use the secondary radiation from the heating units 100 for the heat radiation to the object 15 to be heated; hence, this configuration provides a heating apparatus having high heating effects for the object 15 to be heated and having excellent heating efficiency. As the material of the reflective plate 17, a metal plate having high reflectivity, made of aluminum, aluminum alloy or stainless steel, or a plate on which a metal film made of aluminum, titanium nitride, nickel, chromium or the like is formed on the surface of a heat-resistant material is used.

Furthermore, in the first heating apparatus, in the inner space between the inner housing 16 and the outer housing 13, a power supply circuit 18 for supplying power to the heating units 100 and a control circuit for controlling the power supply to the heating units 100 are provided together with the external lead wires 8 extended from the sealed portions provided at both ends of each heating unit 100.

In the second heating apparatus shown in FIG. 9, the heating unit, in which the reflective sheet 12 described in Embodiment 2 is disposed in the clearance between the first glass tube 1 and the second glass tube 9, is disposed below the wire net 14 on which an object to be heated is placed. The heating unit 101 is secured to an inner housing 20, in which a heating area being open upward is formed, at the positions of the caps 10 provided on both ends thereof. The cap 10 provided at each of both ends is tightly fitted in a hole formed in the inner housing 20 and secured thereto. It may also be possible that the heating unit 101 is secured to the inner housing 20 using hermetically sealing members 22 having thermal resistance and flexibility, such as rubber bushings. By the use of the hermetically sealing members 22 as described above, the space inside the apparatus and between an outer housing 21 constituting the outer appearance of the heating apparatus and the inner housing 20 is securely isolated from the heating area, preventing inflow of contaminants from the heating area.

The reflective plate 17 used in the first heating apparatus may be provided on the bottom face of the inner housing 20 in the second heating apparatus shown in FIG. 9. In this case, the reflective plate 17 is disposed so that the heat radiated from the rear side (the side not opposed to the wire net 14) of the heating element 2*a* of the heating unit 101 (excluding the heat reflected using the reflective sheet 12) is reflected to the object 15 to be heated, which is placed on the wire net 14. In the second heating apparatus shown in FIG. 9, in the case that the reflective plate 17 is provided on the bottom face of the inner housing 20 constituting the heating area, this configuration provides a heating apparatus having higher heating effects for the object 15 to be heated and having excellent heating efficiency.

Furthermore, just as in the case of the first heating apparatus described above, in the second heating apparatus, in the inner space between the inner housing 20 and the outer housing 21, a power supply circuit for supplying power to the heating unit 101 and a control circuit for controlling the power supply to the heating unit 101 are provided together with the external lead wires 8 extended from the sealed portions provided at both ends of the heating unit 101.

In the heating apparatuses according to Embodiment 3, the heating units 100 and 101 are secured to the inner housings 16 and 20 at the positions of the caps 10; hence, contaminants generated in the usage environment during heating are prevented from flowing out from the heating area to the inner space.

Furthermore, because the hermetically sealing members 22 are used at the fitting portions between the heating units 100 and 101 and the inner housings 16 and 20, inflow of contaminants to the inner space is prevented securely, no contaminants adhere to electric components disposed in the inner space; hence, it is possible to provide a heating apparatus having higher reliability and a longer service life.

In the heating apparatuses according to Embodiment 3, because the first glass tube 1 is protected during heating against contaminants generated in the usage environment during heating using the second glass tube 9 and the caps 10, the first glass tube 1 can be used for a long time, and the service life of the entire apparatus can be extended. In addition, the inner spaces between the inner housings 16 and 20 and the outer housings 13 and 21 are shielded from the high temperature region using the inner housings 16 and 20, and in the inner spaces, the sealed portions of each heating unit, the external lead wires 8 extended from the sealed portions, and components being low in thermal resistance, such as electric circuits, are disposed; hence, the service lives of the heating apparatuses are extended.

In the heating apparatuses according to Embodiment 3, in the case that cooking is carried out in the inner housings 16 and 20 serving as heating areas, the object 15 to be heated is placed on the wire net 14, and desired power is supplied to the heating unit, and the object 15 to be heated is heated to a desired temperature. At this time, contaminants, such as oily smoke and seasoning agents, generated from the object 15 to be heated and filling the heating area, are shut off using the second glass tube 9 and the caps 10, and do not reach the first glass tube 1. For this reason, the contaminants are prevented from adhering to the first glass tube 1, thereby not causing devitrification or breakage. In Embodiment 3, although the heating apparatus is described as a cooking apparatus, the heating apparatus is also useful as various types of heating apparatuses that are used as heat sources; for example, even in a state in which aqueous solutions and vapor are generated in the heating area, the aqueous solutions and vapor do not flow into the inner space between the inner housing and the outer housing, and it is possible to construct a heating apparatus having a long service life.

In the heating apparatuses according to Embodiment 3, a configuration wherein electric circuits for supplying power to the heating units 100 and 101 and for controlling them are disposed is described; however, the present invention is not limited to this kind of configuration, and it is needless to say that similar effects are obtained even in a configuration wherein the electric circuits are disposed outside the outer housing of each heating apparatus.

Although the first heating apparatus shown in FIG. 8 is described using the heating unit described in Embodiment 1, the heating apparatus may be configured using the heating unit having the reflective sheet 12 and described in Embodiment 2. In the case of this configuration, heating having higher directivity can be attained using the reflective sheet 12 of the heating unit.

In addition, the heating apparatuses according to Embodiment 3 can be used to provide a wider heating face, a spot heating face and the like depending on the applications by changing the positions and shapes of the reflective means (the reflective sheet 12 and the reflective plate 17) in the heating unit.

In the heating apparatuses according to Embodiment 3 described above, the heating units and the reflective means are disposed as heat sources; hence, the heating apparatuses can carry out wide-range heating, heating using parallel heat rays, uniform heating using diffused reflection, pollution-free heating, and heating with high radiation efficiency, thereby having high versatility depending on the object to be heated and the usage environment.

In the present invention, the heating apparatus is defined to include electric radiant heaters, such as heaters for warming purposes; cookers for cooking purposes; driers for drying foods; heaters for heating aqueous solutions; electronic apparatuses for fixing toner, such as copying machines, facsimile machines and printers; and apparatuses required to carry out heating to high temperatures in a short time.

In the heating apparatuses according to Embodiment 3, in the case that the control circuit is used to carry out power supply control for the heating unit, it is also possible to carry out control in consideration of temperature conditions as power supply control selection conditions. Temperature control is carried out by ON/OFF control using a temperature detecting means, such as a thermostat, input power supply phase control using a temperature sensor that senses accurate temperatures, power supply ratio control, zero-cross control or the like, singularly or in combination of them; hence, it is possible to realize a heating apparatus capable of carrying out highly accurate temperature control. Therefore, in the heating apparatus according to Embodiment 3 configured as described above, heating being excellent in radiation characteristics and highly accurate temperature control can be attained by carrying out control for changing the direction of the flat face portion of the heating element (for controlling the disposition of the reflective plate 17) and power supply control.

In Embodiment 1 to Embodiment 3, the heating unit being configured such that the heating element is sealed using the first glass tube 1 is described; however, it is needless to say that similar effects are obtained in a heating unit having a heating element that is not required to be sealed. In other words, the heating unit may be configured by disposing the heating element structure 2 inside the first glass tube 1 in an unsealed open state, by incorporating the first glass tube 1 in the second glass tube 9, and by providing the caps 10 and/or the spacers 11 described in Embodiments 1 and 2 described above.

Figure 10:
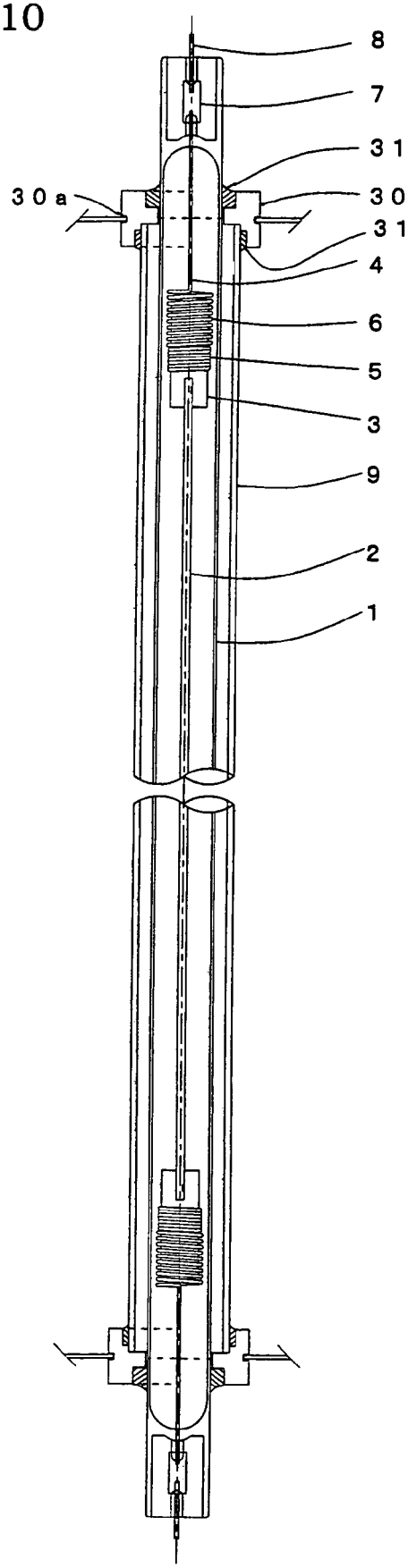
FIG. 10 is a cross-sectional view showing another structure of a heating unit according to the present invention.

In Embodiment 1 to Embodiment 3, the cap 10 is provided for hermetically sealing the predetermined interval (clearance) between the first glass tube 1 as a first diathermanous tube and the second glass tube 9 as a second diathermanous tube. The cap 10 is made of rubber having elasticity and is disposed so as to cover the spacer 11 for securing the predetermined interval. In other words, the second glass tube 9 is fixed to the first glass tube 1 by using the cap 10 so as to hermetically seal the space between the first glass tube 1 and the second glass tube 9. The aforementioned fixing means is not to be interpreted as limiting the invention. For example, there is a fixing means shown in FIG. 10. FIG. 10 is a cross-sectional view showing a structure of a heating unit which has a fixing ring 30 as a cap. The fixing ring 30 is attached to the both end portions of the first glass tube 1. An end of the second glass tube 9 is fixed to a step portion which is formed on the inner face of the fixing ring 30. The clearance between the first glass tube 1 and the second glass tube 9 is held by the fixing ring 30, and the space between the first glass tube 1 and the second glass tube 9 is hermetically sealed by the fixing ring 30. The contacting areas between the fixing ring 30 and the first glass tube 1, and between the fixing ring 30 and the second glass tube 9 are coated with adhesive 31 as binder to be fixed each other. As the adhesive 31, such as an inorganic thermal-resistant adhesive including alumina as main material, and further including silicon dioxide or magnesium oxide can be used. As the material of the fixing ring 30, ceramic or metal, such as steatite alumina, aluminum, stainless steel or the like can be used.

The outer face of the fixing ring 30 is grooved as a narrow groove **30*a* to be orthogonal to the longitudinal direction of the heating unit. The groove 30*a* is formed for positioning the heating unit when the heating unit is assembled in the heating apparatus. The groove 30*a*** is fitted with a support part in the heating apparatus.

As mentioned above, since the fixing ring 30 is provided in the heating unit, the clearance between the first glass tube 1 and the second glass tube 9 is held accurately to have the predetermined interval without a spacer. And the heating unit is easily and accurately attached to the heating apparatus; hence, it is possible to provide a heating apparatus having higher reliability.

Figure 11:
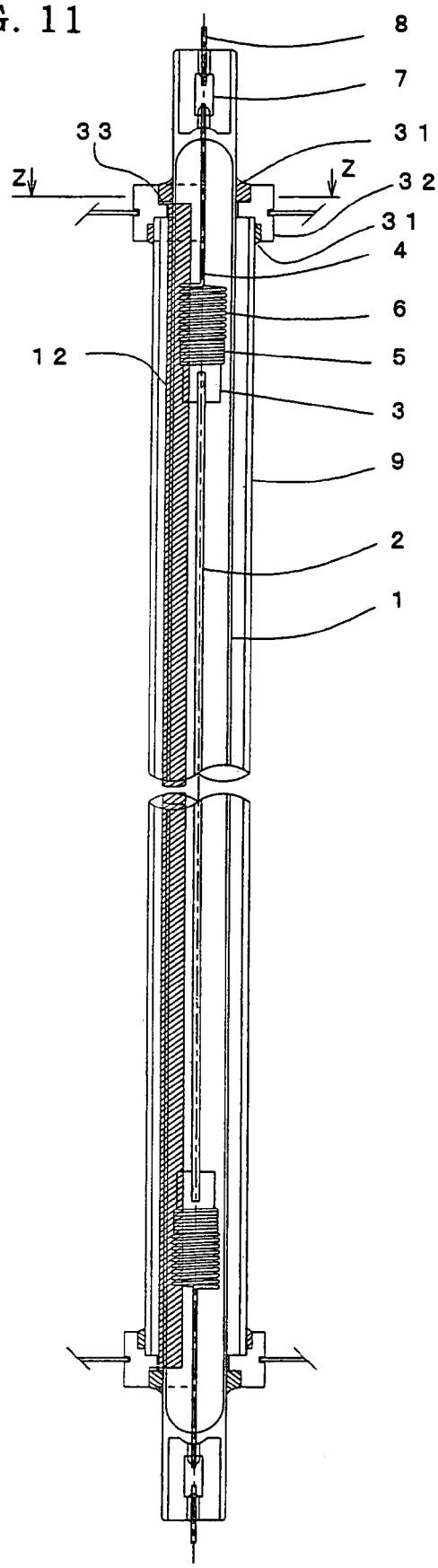
FIG. 11 is a cross-sectional view showing another structure of a heating unit according to the present invention.
Figure 12:
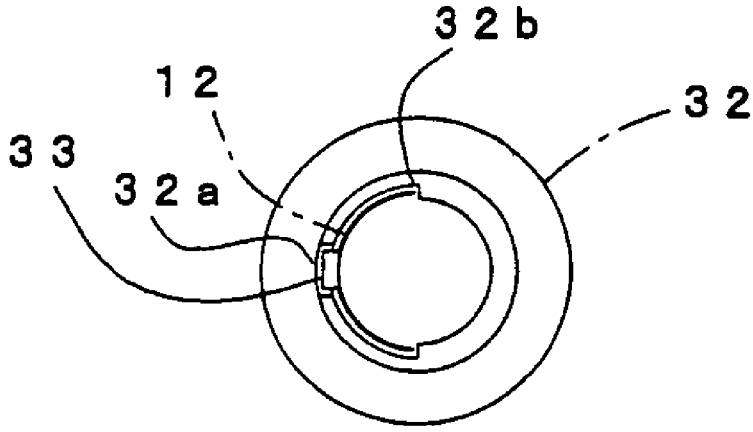
FIG. 12 is a cross-sectional view taken along the line Z-Z in the heating unit of FIG. 11.
Figure 13:
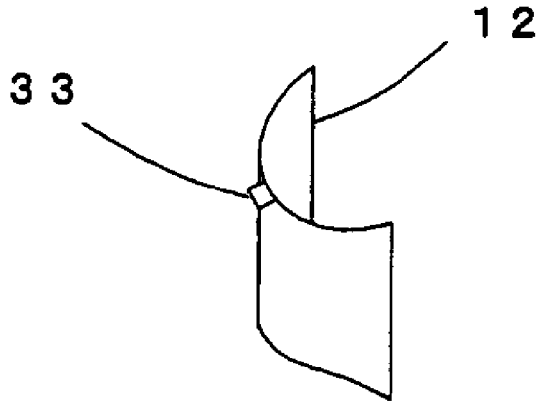
FIG. 13 is a perspective view showing a reflecting means in the heating unit of FIG. 11.

FIG. 11 is a cross-sectional view showing another structure of a heating unit which has a fixing ring, and a reflective sheet 12 as reflective means is provided to the heating unit. FIG. 12 is a cross-sectional view taken along the line Z-Z of FIG. 11; FIG. 12 is a cross-sectional view of a fixing ring 32. FIG. 13 is a perspective view showing an end portion of the reflective sheet 12. In FIG. 11, the fixing ring 32 as a cap is provided for hermetically sealing the predetermined space having interval (clearance) between the first glass tube 1 and the second glass tube 9, and for fixing the reflective sheet 12 to the first glass tube 1.

As shown in FIG. 12, a hollow 32*b* is formed on the inner face of the fixing ring 32 to extend in a longitudinal direction of the fixing ring 32. The reflective sheet 12 is disposed in the hollow 32*b* . As a result, the reflective sheet 12 is accurately disposed at the predetermined position in the circumferential direction to the fixing ring 32. And further, the reflective sheet 12 can be accurately arranged in the longitudinal direction of the first glass tube 1 in case of that the end of the reflective sheet 12 is closely connected to the fixing ring 32 by the inorganic thermal-resistant adhesive 31.

A hole 32*a* is formed on the inner face of the fixing ring 32 so as to engage with a protuberance 33 which is formed on the ends of the reflective sheet 12, as shown in FIG. 13. As a result, the reflective sheet 12 is accurately positioned in a circumferential direction and a longitudinal direction on the first glass tube 1 by the fixing ring 32 of the heating unit. It is needless to say that it is increasing the sealing property of the heating unit in case of that the end of the reflective sheet 12 is closely connected to the fixing ring 32 by the inorganic thermal-resistant adhesive 31.

Figure 14:
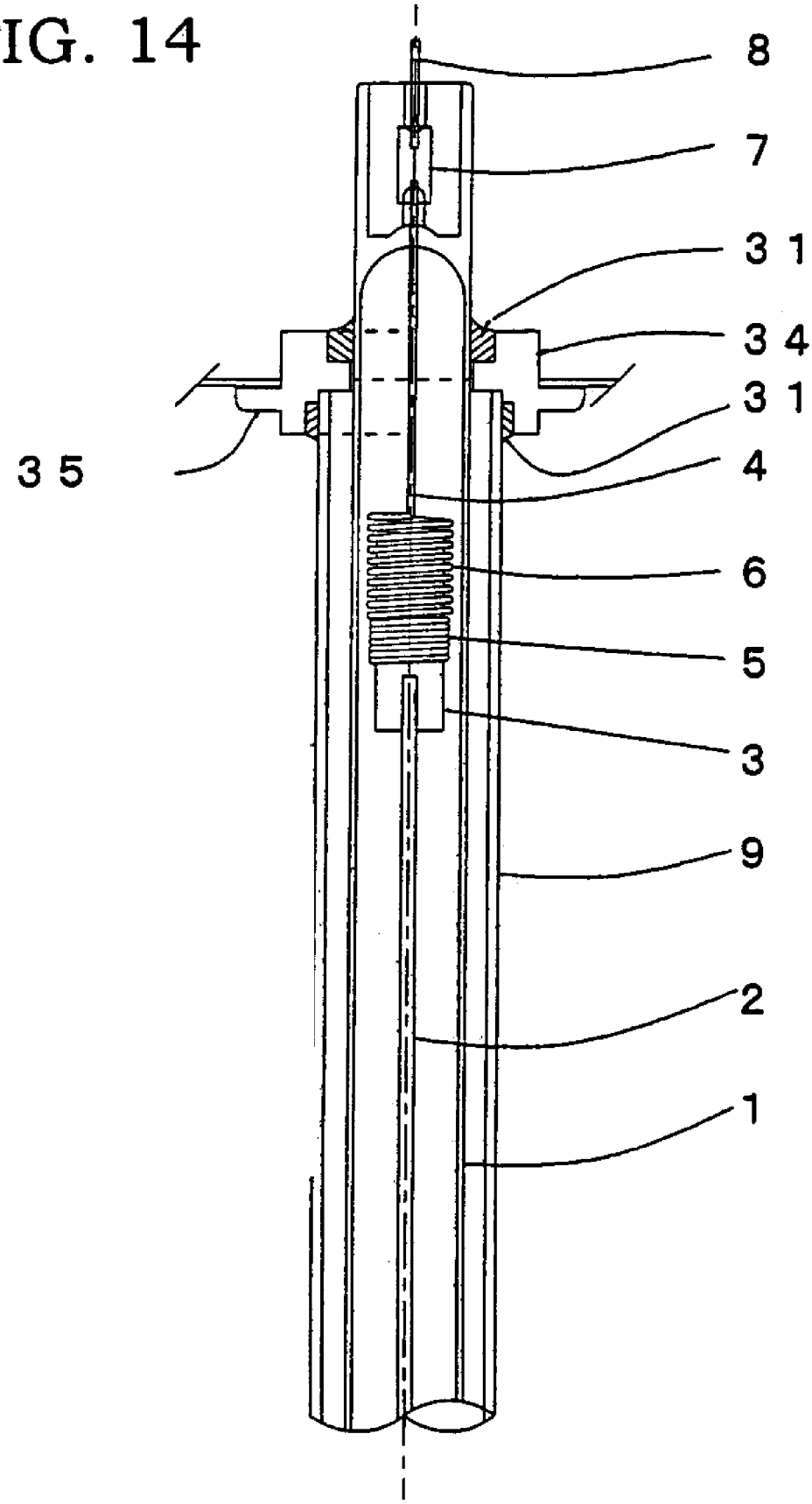
FIG. 14 is a cross-sectional view showing another structure of a heating unit according to the present invention.

FIG. 14 is a cross-sectional view showing another modified structure of a heating unit which has a fixing ring as a cap. As shown in FIG. 14, a projection 35 like a brim is formed on the outer face of the fixing ring 34. As a result, the heating unit is configured to be easily attached to the support parts of the heating apparatus in which the heating unit attached as heating source.

The heating units shown in FIGS. 10 to 13 are configured by the same structure and materials as the aforementioned Embodiment 1 to Embodiment 3 except the fixing rings 30, 32 and 34; hence, it is needless to say that similar effect are obtained by the heating units of FIGS. 10 to 13.

The heating unit according to the present invention has the two glass tubes 1 and 9, being different in diameter, wherein the first glass tube 1 incorporates the heating element 2*a*, the second glass tube 9 incorporates the first glass tube 1, and the caps 10 are provided to hermetically seal the connection portions at the ends of the first glass tube 1 and the second glass tube 9. In the heating unit according to the present invention configured as described above, the first glass tube 1 incorporating the heating element 2*a* is protected using the caps 10 that carry out hermetic sealing between the first glass tube 1 and the second glass tube 9. Hence, contaminants generated in the usage environment are prevented from adhering to the first glass tube 1, and the long service life and downsizing of the heating unit can be attained.

Furthermore, in the heating unit according to the present invention, the reflective sheet 12 is provided, as opposed to the heating element 2*a*, in the clearance between the first glass tube 1 incorporating the heating element 2*a* and the second glass tube 9 incorporating the first glass tube 1. In the heating unit according to the present invention configured as described above, the directivity of the heat radiation from the heating element 2*a* can be raised, the contamination of the reflective sheet 12 can be prevented, and high radiation efficiency can be maintained. Moreover, by providing the heating unit configured as described above as the heat source of a heating apparatus, it is possible to provide a heating apparatus being small and having high directivity and high heating efficiency.

The heating element 2*a* in the heating unit according to the present invention may be made of a heating material that is oxidized at high temperatures, such as a solid carbonaceous heating element inclining a carbonaceous substance and a resistance adjustment substance and formed by firing. The emissivity of the heating element 2*a* configured as described above is higher than that of a metallic material by 80% or more. In addition, by the use of the heating element 2*a* described above, it is possible to configure a heating unit having higher primary radiation, a large amount of heat radiation to an object to be heated and high radiation efficiency. Furthermore, the heating element 2*a* in the heating unit according to the present invention can be formed in various sizes by changing its specific resistivity value, and can be applied to the heat sources of heating apparatuses having various configurations. Moreover, the present invention can provide a heating unit being small and having high radiation efficiency.

The heating element 2*a* in the heating unit according to the present invention has a substantially plate-like shape having nearly flat faces, and the width of the heating element 2*a* may be five or more times larger than the thickness. In the heating unit according to the present invention configured so as to have the heating element 2*a* described above, the heating element itself can carry out heat radiation having directivity; and the directivity can be raised by disposing the reflective sheet 12 serving as a reflective means in parallel or orthogonal with the nearly flat face of the heating element 2*a*. Furthermore, with the present invention, by the use of the primary radiation from the heating element 2*a* and the secondary radiation from the reflective sheet 12, heat is radiated to an object to be heated depending on the purpose; hence, it is possible to provide a-heating unit having an appropriate radiation range and high radiation efficiency.

The heating apparatus according to the present invention is provided with the heating unit having the two glass tubes 1 and 9, being different in diameter, wherein the first glass tube 1 incorporates the heating element, the second glass tube 9 incorporates the first glass tube 1, and the caps 10 are provided to hermetically seal the connection portions at the ends of the first glass tube 1 and the second glass tube 9; furthermore, the reflective plate 17 serving as a reflective means is provided as opposed to the heating unit.

In addition, the heating apparatus according to the present invention is provided with the heating unit having the reflective sheet 12 that serves as a reflective means, is opposed to the heating element 2*a* and is disposed in the clearance between the first glass tube 1 incorporating the heating element 2*a* and the second glass tube 9 incorporating the first glass tube 1; and the electric circuits for supplying power to the heating unit and for controlling the heating unit are disposed in the space that is shielded using the inner housing from the heating area in which the heating element 2*a* of the heating unit is disposed. Furthermore, the terminals for supplying power to the heating unit, that is, both ends of the heating unit, are disposed in the space in which the electric circuits are disposed. In the heating apparatus according to the present invention configured as described above, by the use of the second glass tube 9 incorporating the first glass tube 1 and the caps 10 for hermetically sealing the connection portions at the ends of the second glass tube 9, the reflective sheet 12 provided in the clearance, the first glass tube 1 and the heating element 2*a* are prevented from being contaminated owing to the usage environment; hence, the long service life and downsizing of the heating unit are attained. Moreover, in the heating apparatus according to the present invention, because the sealed portions of the heating unit are disposed in the space that is different from the heating area and shielded using the inner housing, the occurrence of accidents, such as wire breakage, in the sealed portions of the heating unit can be suppressed, and the service life of the heating unit can be extended. By the use of the heating unit configured as described above for a heating apparatus, the apparatus is small and has high radiation efficiency and a long service life.

The heating apparatus according to the present invention has the control circuit for electrically controlling the heating unit, and the control circuit is configured using respective circuits for ON/OFF control, power supply ratio control, phase control and zero-cross control, singularly or in combination of at least two; hence, the heating apparatus can carry out highly accurate temperature control. Furthermore, with the present invention, because an object to be heated is heated properly at a desired temperature, the temperature of the heating element is controlled properly, the input of extra energy to the heating element is prevented; hence, it is possible to provide a heating apparatus that attains energy saving.

The heating apparatus in which the heating unit according to the present invention is used as a heat source can be used as the heating sections of electric heaters (heaters and the like), electric cookers, aqueous solution heaters, electronic apparatuses, etc., thereby having a configuration with excellent heating functions.

The heating apparatus in which the heating unit according to the present invention is used as a heat source can be used for various apparatuses that require heat sources, and is useful as a heating apparatus having high versatility.

What is claimed is:

1. A heating unit comprising:

a heating element structure having a heating element, a first diathermanous tube incorporating said heating element structure, a second diathermanous tube which is penetrated by said first diathermanous tube to project the both sides of said first diathermanous tube from the both ends of said second diathermanous tube, and which is disposed so as to have a predetermined clearance from the outer circumferential face of said first diathermanous tube, and fixing means which provide the clearance between said first diathermanous tube and said second diathermanous tube, and are attached to the both end portions of said second diathermanous tube so as to prevent to move in an axial direction of said second diathermanous tube, wherein said heating element structure comprises said heating element, lead wires extended from both ends of said first diathermanous tube, and heating element holding means for connecting said heating element to said lead wires, an inert gas is sealed inside said first diathermanous tube which is sealed by sealed portions at both ends of said first diathermanous tube, portions of said lead wires are embedded in the sealed portions of said first diathermanous tube, and said fixing means is disposed at an area between a heating element side end of said sealed portion and a heating element side end of said heating element holding means in the axis direction of said first diathermanous tube.

2. The heating unit according to claim 1, wherein reflective means is disposed in the clearance between said first diathermanous tube and said second diathermanous tube, and the reflective face of said reflective means is disposed as opposed to said heating element.

3. The heating unit according to claim 2, wherein said first diathermanous tube is formed of a glass tube hermetically incorporating said heating element structure, and said second diathermanous tube is formed of a cylindrical glass tube incorporating said first diathermanous tube.

4. The heating unit according to claim 2, wherein said second diathermanous tube is formed of a tube made of an inorganic material having thermal resistance, at least one selected from among a silica glass tube, a high-silica glass tube, a low-alkali borosilicate glass tube, a crystallized glass tube and a ceramic tube.

5. The heating unit according to claim 2, wherein said reflective means is formed of a metal film.

6. The heating unit according to claim 2, wherein said reflective means is formed of a metal film made of nickel, ferritic stainless steel or nichrome.

7. The heating unit according to claim 2, wherein said heating element is a carbonaceous heating element formed by firing.

8. The heating unit according to claim 2, wherein said heating element is a plate-like carbonaceous heating element configured so as to include a carbonaceous substance and a resistance adjustment substance and formed by firing.

9. The heating unit according to claim 2, wherein said heating element is a strip-shaped carbonaceous heating element configured so as to include carbonaceous fiber.

10. The heating unit according to claim 8, wherein said heating element has a substantially plate-like shape, the width of which is five or more times larger than the thickness thereof, and the face constituting the width of said heating element is a substantially flat face.

11. The heating unit according to claim 2, wherein said heating element has a substantially plate-like shape, the width of which is five or more times larger than the thickness thereof, and the reflective face of said reflective means is disposed as opposed to the substantially flat face constituting the width of said heating element.

12. The heating unit according to claim 2, wherein said heating element has a substantially plate-like shape, the width of which is five or more times larger than the thickness thereof, and the reflective face of said reflective means is disposed in orthogonal with the substantially flat face constituting the width of said heating element.

13. A heating apparatus comprising:

said heating unit according to claim 2, a power supply circuit connected to the lead wires of said heating unit, and a housing for holding said heating unit in a liquid-tight state and for isolating said lead wires from a heating area.

14. The heating apparatus according to claim 13, wherein reflective means is disposed as opposed to said heating element in said heating area of said housing.

15. The heating apparatus according to claim 13, wherein a control circuit for controlling the heating of said heating unit is provided, and said control circuit is configured using respective circuits for ON/OFF control, power supply ratio control, phase .control and zero-cross control, singularly or in combination of at least two.

16. The heating unit according to claim 1, wherein said fixing means provides the clearance between said first diathermanous tube and said second diathermanous tube, as well as said fixing means includes a fixing ring for hermetically sealing the space formed by the clearance between said first diathermanous tube and said second diathermanous tube.

17. The heating unit according to claim 16, wherein said fixing means includes a binder by which said fixing ring is fixed to the both ends of said second diathermanous tube and the outer circumferential face of said first diathermanous tube.

18. The heating unit according to claim 16, wherein said fixing ring is formed by ceramic material.

19. The heating unit according to claim 17, wherein said binder is composed of an inorganic thermal-resistant adhesive.

20. The heating unit according to claim 1, wherein said fixing means includes spacers which are disposed at the clearance between said first diathermanous tube and said second diathermanous tube so as to provide the clearance between said first diathermanous tube and said second diathermanous tube, and caps having elasticity for hermetically sealing the space formed by the clearance between said first diathermanous tube and said second diathermanous tube.

21. The heating unit according to claim 1, wherein said fixing means which are fixed to the both side portions of said first diathermanous tube, and which is penetrated by the end portions of said first diathermanous tube so that said sealed portions formed at both sides of said first diathermanous tube are disposed outside of said fixing means, and said fixing means includes an attaching means for disposing said heating element structure in a heating area of said heating apparatus, when said heating element structure is disposed in the heating space of said heating apparatus by said attaching means, the end portions of said first diathermanous tube including said sealed portions are disposed out of the heating space.

* * * * *